US009865419B2

(12) United States Patent
Blackmon et al.

(10) Patent No.: US 9,865,419 B2
(45) Date of Patent: Jan. 9, 2018

(54) PRESSURE-CONTROLLED ELECTRICAL RELAY DEVICE

(71) Applicant: TYCO ELECTRONICS CORPORATION, Berwyn, PA (US)

(72) Inventors: Terrance Edward Blackmon, Winston-Salem, NC (US); Roger L. Thrush, Clemmons, NC (US); Ralph Glenn Vestal, Lexington, NC (US); Douglas Foster Brandon, Greensboro, NC (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/152,133

(22) Filed: May 11, 2016

(65) Prior Publication Data

US 2016/0365210 A1 Dec. 15, 2016

Related U.S. Application Data

(60) Provisional application No. 62/174,565, filed on Jun. 12, 2015.

(51) Int. Cl.
*H01H 3/00* (2006.01)
*H01H 50/12* (2006.01)
(Continued)

(52) U.S. Cl.
CPC ..... *H01H 50/12* (2013.01); *H01H 9/043* (2013.01); *H01H 50/023* (2013.01);
(Continued)

(58) Field of Classification Search
CPC ..... H01H 9/00; H01H 51/06
(Continued)

(56) References Cited

U.S. PATENT DOCUMENTS 2,086,752 A * 7/1937 Thornburg ..... H01H 13/62 200/469
3,470,504 A * 9/1969 Rogers ..... H01H 51/065 335/78
(Continued)

FOREIGN PATENT DOCUMENTS

DE 102014104935 A1 * 10/2014 ..... F02N 15/066
EP 0130500 A2 1/1985
(Continued)

OTHER PUBLICATIONS

International Search Report dated Sep. 6, 2016 received in International Application No. PCT/US2016/036562.

*Primary Examiner* — Shawki S Ismail
*Assistant Examiner* — Lisa Homza

(57) ABSTRACT

An electrical relay device includes a housing, a wire coil, an actuator assembly, and a shell. The housing extends between a closed end and an open end and defines a chamber. The wire coil and the actuator assembly are within the chamber. The actuator assembly is configured to move between a first position, in which a movable contact is spaced apart from at least one stationary contact, and a second position, in which the movable contact engages the at least one stationary contact, based on a magnetic field induced by current through the wire coil. The shell seals the open end of the housing to seal the chamber. The shell has a pressure relief valve in flow communication with the chamber. The pressure relief valve is configured to open in response to a pressure within the chamber exceeding a threshold set pressure to reduce the pressure within the chamber.

20 Claims, 3 Drawing Sheets

(51) Int. Cl.
*H01H 50/60* (2006.01)
*H01H 50/02* (2006.01)
*H01H 51/29* (2006.01)
*H01H 9/04* (2006.01)

(52) U.S. Cl.
CPC ..... *H01H 50/60* (2013.01); *H01H 51/29* (2013.01); *H01H 50/026* (2013.01); *H01H 2050/025* (2013.01)

(58) Field of Classification Search
USPC ..... 335/185
See application file for complete search history.

(56) References Cited

U.S. PATENT DOCUMENTS 3,563,757 A * 2/1971 Dixon ..... A23L 3/3418 99/472
4,421,959 A * 12/1983 Chen ..... H01H 9/38 200/16 A
4,450,423 A * 5/1984 Morishita ..... H01H 51/065 335/131
4,510,914 A * 4/1985 Purser ..... F02M 11/02 123/548
5,197,665 A * 3/1993 Jenson ..... F23N 5/203 236/20 R
5,385,452 A * 1/1995 Lyday ..... F01B 11/02 417/403
5,394,128 A * 2/1995 Perreira ..... H01H 33/66 335/126
5,411,100 A * 5/1995 Laskaris ..... A62C 5/02 169/14
5,519,370 A * 5/1996 Perreira ..... H01H 3/001 218/123
6,712,238 B1 * 3/2004 Mills ..... E04F 21/08 222/399
7,852,178 B2 * 12/2010 Bush ..... H01H 51/2209 335/126
7,859,373 B2 * 12/2010 Yamamoto ..... H01H 50/305 335/126
8,138,872 B2 * 3/2012 Yoshihara ..... H01F 7/1615 335/124
8,179,217 B2 * 5/2012 Kawaguchi ..... H01F 7/1615 335/124
8,188,818 B2 * 5/2012 Cho ..... H01H 50/023 335/126
8,232,499 B2 * 7/2012 Bush ..... H01H 1/64 218/156
8,269,585 B2 * 9/2012 Choi ..... H01H 1/2008 335/126
8,653,917 B2 * 2/2014 Takaya ..... H01H 9/443 335/126
8,941,453 B2 * 1/2015 Yano ..... H01H 1/66 335/131
9,384,927 B2 * 7/2016 An ..... H01H 9/30
2006/0059904 A1 * 3/2006 Shevket ..... B60K 7/0015 60/325
2006/0272704 A1 * 12/2006 Fima ..... E03B 7/071 137/12
2006/0272830 A1 * 12/2006 Fima ..... E03B 1/00 169/16
2008/0084260 A1 * 4/2008 Swartzentruber .... H01H 50/023 335/151
2008/0122562 A1 5/2008 Bush et al.
2008/0202842 A1 * 8/2008 Shevket ..... B60K 7/0015 180/442
2009/0048594 A1 * 2/2009 Sartor ..... A61B 18/042 606/41
2012/0067594 A1 * 3/2012 Noske ..... E21B 34/08 166/373

FOREIGN PATENT DOCUMENTS

EP 2442332 A1 4/2012
WO 2010/000825 A1 1/2010

* cited by examiner

PRESSURE-CONTROLLED ELECTRICAL RELAY DEVICE

CROSS-REFERENCE TO RELATED APPLICATIONS

This application claims priority to U.S. Provisional Application No. 62/174,565, filed 12 Jun. 2015, which is incorporated by reference in its entirety.

BACKGROUND OF THE INVENTION

The subject matter herein relates generally to electrical relay devices.

Electrical relay devices are generally electrically operated switches used to control the presence or absence of current flowing through a circuit between electrical components, such as from a power source to one or more electrical components that receive power from the power source. The power source may be one or more batteries, for example. Some electrical relays use an electromagnet to mechanically operate a switch. The electromagnet is configured to physically translate a movable electrical contact relative to one or more stationary contacts. The movable electrical contact may form or close a circuit (allowing current to flow through the circuit) when the movable contact engages one or more of the stationary contacts. Moving the movable electrical contact away from the stationary contact(s) breaks or opens the circuit (ceasing the flow of current through the circuit).

At least some electrical relay devices include a ferromagnetic element that is disposed at least proximate to the electromagnet such that an induced magnetic field applies a magnetic force upon the ferromagnetic element that translates the ferromagnetic element relative to the electromagnet. The ferromagnetic element is coupled to a shaft, which extends from the ferromagnetic element to the movable electrical contact. The shaft is coupled to both the ferromagnetic element and the movable electrical contact. Therefore, movement of the ferromagnetic element due to the induced electrical field causes movement of the shaft and the movable electrical contact towards and away from the one or more stationary contacts, forming and braking the circuit as described above.

Known electrical relay devices have some disadvantages. For example, some electrical relay devices are sealed from the external environment, which protects the components of the relay device against dust, humidity, and other contaminants. However, known sealed electrical relay devices risk damage and/or destruction due to build-up of temperature and/or pressure within the sealed region of the relay device. Such a build-up of temperature and/or pressure may occur as a result of a fault in which too much electrical energy (for example, current and/or voltage) is supplied to the relay device. For example, an electrical relay device may be rated for handling 420 volts (V) and 135 amperes (A), but, due to a fault in which an up-stream resistor is defective and fails to limit the current, for example, the relay device may receive too much electrical energy, such as 420 V and 400 A. The high current may heat up the gas in the sealed relay device, causing the pressure to increase as the gas expands. As the pressure exceeds the structural limits of the relay device, the relay device may bulge and deform. Eventually, the relay device may burst or explode, destroying the relay device and causing the relay device to be immediately inoperable.

A need remains for an electrical relay device that is better able to control the pressure within the sealed region to prohibit the electrical relay device from bursting due to a fault such that the electrical relay device is at least partially functional after experiencing a fault.

BRIEF DESCRIPTION OF THE INVENTION

In an embodiment, an electrical relay device is provided that includes a housing, a coil of wire, an actuator assembly, and a shell. The housing extends between a closed end and an open end. The housing defines a chamber. The coil of wire is within the chamber of the housing. The coil of wire is electrically connected to a relay power source. The actuator assembly is within the chamber of the housing. The actuator assembly is configured to move between a first position and a second position based on a presence or absence of a magnetic field that is induced by current through the coil of wire. The actuator assembly includes a movable contact that is spaced apart from at least one stationary contact within the chamber when the actuator assembly is in the first position and engages the at least one stationary contact to provide a closed circuit path when the actuator assembly is in the second position. The shell is coupled to the housing at the open end. The shell seals the open end of the housing to seal the chamber. The shell has a pressure relief valve in flow communication with the chamber. The pressure relief valve is configured to open in response to a pressure within the chamber exceeding a threshold set pressure in order to reduce the pressure within the chamber.

In another embodiment, an electrical relay device is provided that includes a housing, a coil of wire, an actuator assembly, and a shell. The housing extends between a closed end and an open end. The housing defines a chamber. The coil of wire is within the chamber of the housing. The coil of wire is electrically connected to a relay power source. The actuator assembly is within the chamber of the housing. The actuator assembly is configured to move between a first position and a second position based on a presence or absence of a magnetic field that is induced by current through the coil of wire. The actuator assembly includes a movable contact that is spaced apart from at least one stationary contact within the chamber when the actuator assembly is in the first position and engages the at least one stationary contact to provide a closed circuit path when the actuator assembly is in the second position. The shell is coupled to the housing at the open end. The shell seals the open end of the housing to seal the chamber. The shell has a pressure relief valve in flow communication with the chamber. The pressure relief valve is configured to open in response to a pressure within the chamber exceeding a threshold set pressure in order to reduce the pressure within the chamber. The shell includes internal walls that extend from a top wall of the shell and sub-divide the chamber into an interior region and an exterior region that is radially exterior of the interior region. The movable contact is disposed within the interior region. The pressure relief valve is disposed in the top wall in flow communication with the exterior region.

DETAILED DESCRIPTION OF THE INVENTION

Figure 1:
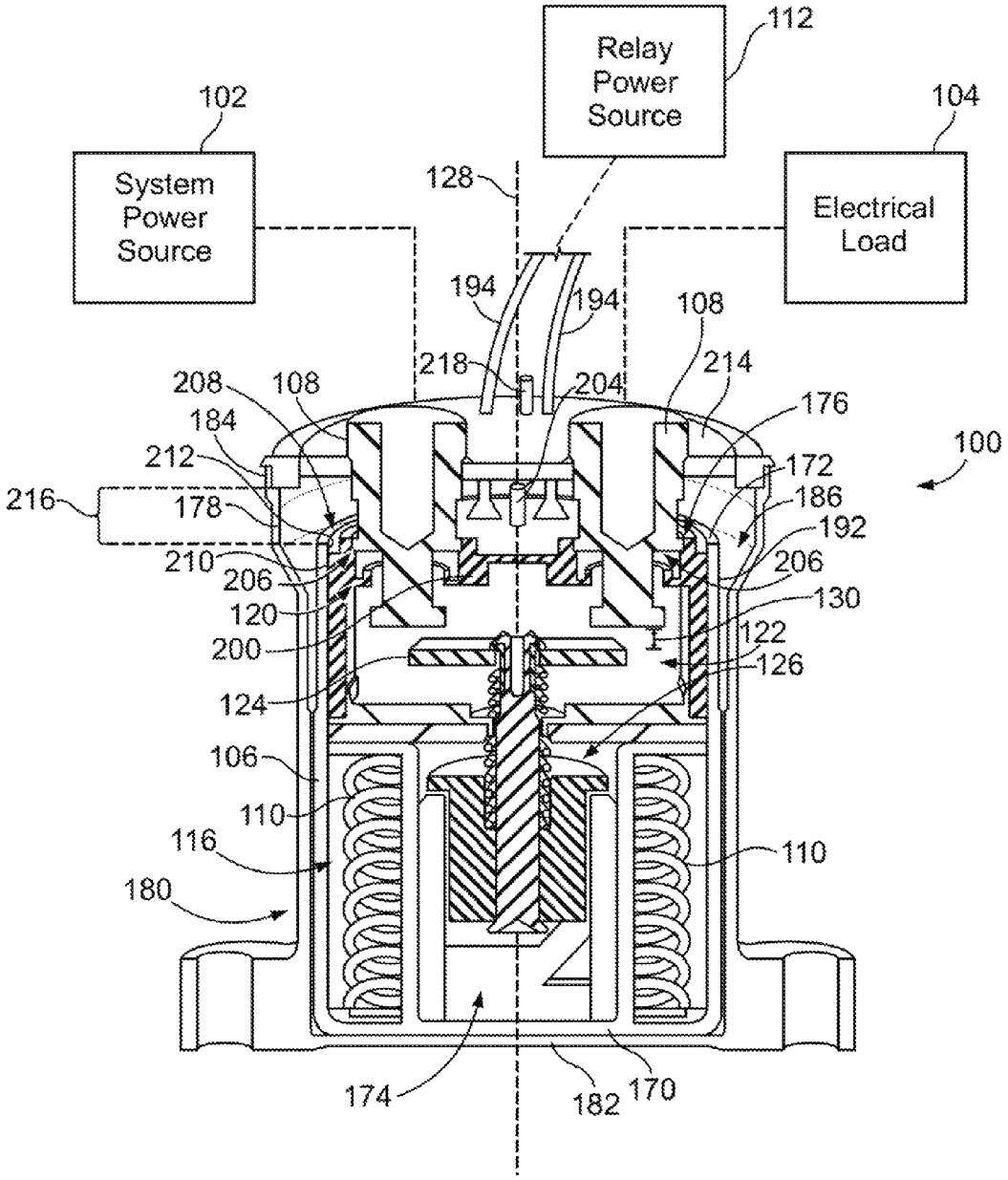
FIG. 1 is a front cross-sectional view of an electrical relay device formed in accordance with an embodiment.

FIG. 1 is a front cross-sectional view of an electrical relay device 100 formed in accordance with an embodiment. The electrical relay device 100 is an electrically operated switch. For example, the electrical relay device 100 is used to control the presence or absence of current flowing through a circuit. The electrical relay device 100 may close (or form) the circuit to allow current to flow through the circuit, and the electrical relay device 100 may open (or break) the circuit to stop the flow of current through the circuit. The electrical relay device 100 is operated to selectively close and open the circuit. Optionally, the circuit may provide a conductive path between at least two electrical components in a system. For example, the electrical components may be a system power source 102 and an electrical load 104 in the system. The system may be a vehicle, such as a train car, an automobile, an off-road vehicle, or the like. When the electrical relay device 100 closes the circuit, electrical current from the system power source 102 flows to the electrical load 104 to power the electrical load 104. The system power source 102 may be one or more batteries, for example. The electrical load 104 may be one or more lighting systems, motors, heating and/or cooling systems, and the like. The electrical relay device 100 in an embodiment may be installed within a vehicle to control the flow of current from a battery (or a series of batteries) to electrical components on the vehicle (for example, headlights, interior lights, radio, navigation display, etc.) to power the electrical components. Alternative, or in addition, the circuit may provide a conductive path for electrical energy to flow from the electrical load 104 to the power source 102 in order to re-charge the power source 102. For example, during regenerative braking, energy is converted to electrical current which may be routed from the brakes through the electrical relay device 100 to the battery (or batteries) of the vehicle.

The electrical relay device 100 includes a housing 106 and various components at least partially within the housing 106. The housing 106 extends between a closed end 170 and an open end 172. The housing 106 defines a chamber 174 that receives the various components of the relay device 100 therein. The open end 172 defines an opening 176 to the chamber 174, which may be the only access location for the chamber 174. For example, the housing 106 may be a can-shaped vessel that is open at the open end 172 and closed at the closed end 170. The housing 106 may have a cylindrical shape extending between the closed end 170 and the open end 172. In other embodiments, the housing 106 may have other than a cylindrical shape, such as a prism shape with multiple linear surfaces extending between the closed end 170 and the open end 172.

In the illustrated embodiment, the housing 106 is an inner housing that is disposed within an outer housing 178 to form a housing assembly 180. The housing 106 is referred to herein as inner housing 106. In other embodiments, however, the housing 106 may be the only housing member, such that the housing 106 is not disposed in another housing member. The outer housing 178 also includes a closed end 182 and an open end 184 and defines a cavity 186 therein. The inner housing 106 is configured to be loaded into the cavity 186 through the open end 184. The closed end 170 of the inner housing 106 may engage the closed end 182 of the outer housing 178 when fully loaded into the cavity 186. The cavity 186 may be sized to have a relatively tight clearance between an inner surface 190 of the outer housing 178 and an outer surface 192 of the inner housing 106 along the length of the housing assembly 180 to limit movement of the inner housing 106 relative to the outer housing 178. Optionally, the inner housing 106 may be held in place relative to the outer housing 178 by an interference fit and/or by using an adhesive or another filler material to fill in gaps between the inner housing 106 and the outer housing 178.

The relay device 100 includes at least one stationary contact 108 held at least partially within the chamber 174 of the inner housing 106. In the illustrated embodiment, the relay device 100 includes two stationary contacts 108, and the stationary contacts 108 are spaced apart from one another to prohibit current from flowing directly between the two stationary contacts 108, such as by arcing. Each stationary contact 108 is configured to be electrically connected to an electrical component that is remote from the electrical relay device 100, such as the system power source 102 and the electrical load 104.

The relay device 100 further includes a coil 110 of wire within the housing 106. The wire coil 110 is electrically connected to a relay power source 112, which provides electrical energy to the wire coil 110 in order to induce a magnetic field. For example, relay power source 112 is electrically connected to the wire coil 110 via electrical conductors 194, such as cables or wires, that provide a conductive current path. The relay power source 112 is operated to selectively control the magnetic field induced by the current through the wire coil 110. In an embodiment, the wire coil 110 is spaced apart from the stationary contacts 108 within the inner housing 106. For example, the wire coil 110 in the illustrated embodiment is disposed proximate to the closed end 170 of the inner housing 106 in an electromagnetic region 116 of the chamber 174. The stationary contacts 108, on the other hand, are disposed proximate to the open end 172 of the inner housing 106 within an electrical circuit region 120 of the chamber 174. As used herein, relative or spatial terms such as "top," "bottom," "front," "rear," "left," and "right" are only used to distinguish the referenced elements and do not necessarily require particular positions or orientations in the electrical relay device 100 or in the surrounding environment of the electrical relay device 100.

The electrical relay device 100 further includes an actuator assembly 122 within the chamber 174 of the inner housing 106. A portion of the actuator assembly 122 is disposed within or at least proximate to the wire coil 110. The actuator assembly 122 is configured to move along an actuation axis 128 between a first position and a second position based on a presence or absence of a magnetic field induced by current through the wire coil 110. The actuator assembly 122 moves along the actuation axis 128 by translating towards and away from the open end 172 of the inner housing 106, for example. The actuator assembly 122 includes a movable contact 124 that is coupled to a carrier sub-assembly 126. The movable contact 124 is coupled to the carrier sub-assembly 126 such that the movable contact 124 moves with the carrier sub-assembly 126 along the actuation axis 128. The movable contact 124 is located within the electrical circuit region 120 of the chamber 174, while part of the carrier sub-assembly 126 is located within the electromagnetic region 116. The actuator assembly 122 is moved by the presence and/or absence of a magnetic force acting upon the carrier sub-assembly 126 in the electromagnetic region 116. For example, when the relay power source 112 applies a current to the wire coil 110, the current through the wire coil 110 induces a magnetic field that acts on the carrier sub-assembly 126, causing the carrier sub-assembly 126 and the movable contact 124 coupled thereto to move along the actuation axis 128. When the current from the relay power source 112 ceases, the wire coil 110 no longer induces the magnetic field that acts upon the carrier sub-assembly 126, and the actuator assembly 122 returns to a starting position. The actuator assembly 122 returns to the starting position due to biasing forces, such as gravity or spring forces.

FIG. 1 shows the actuator assembly 122 in the first position. When the actuator assembly 122 is in the first position, the movable contact 124 is spaced apart from the stationary contacts 108 such that the movable contact 124 is not directly engaged with or conductively connected with either of the stationary contacts 108. The movable contact 124 is separated from the stationary contacts 108 by a gap 130 that extends along the actuation axis 128. The first position of the actuator assembly 122 may be referred to herein as an open circuit position.

Figure 2:
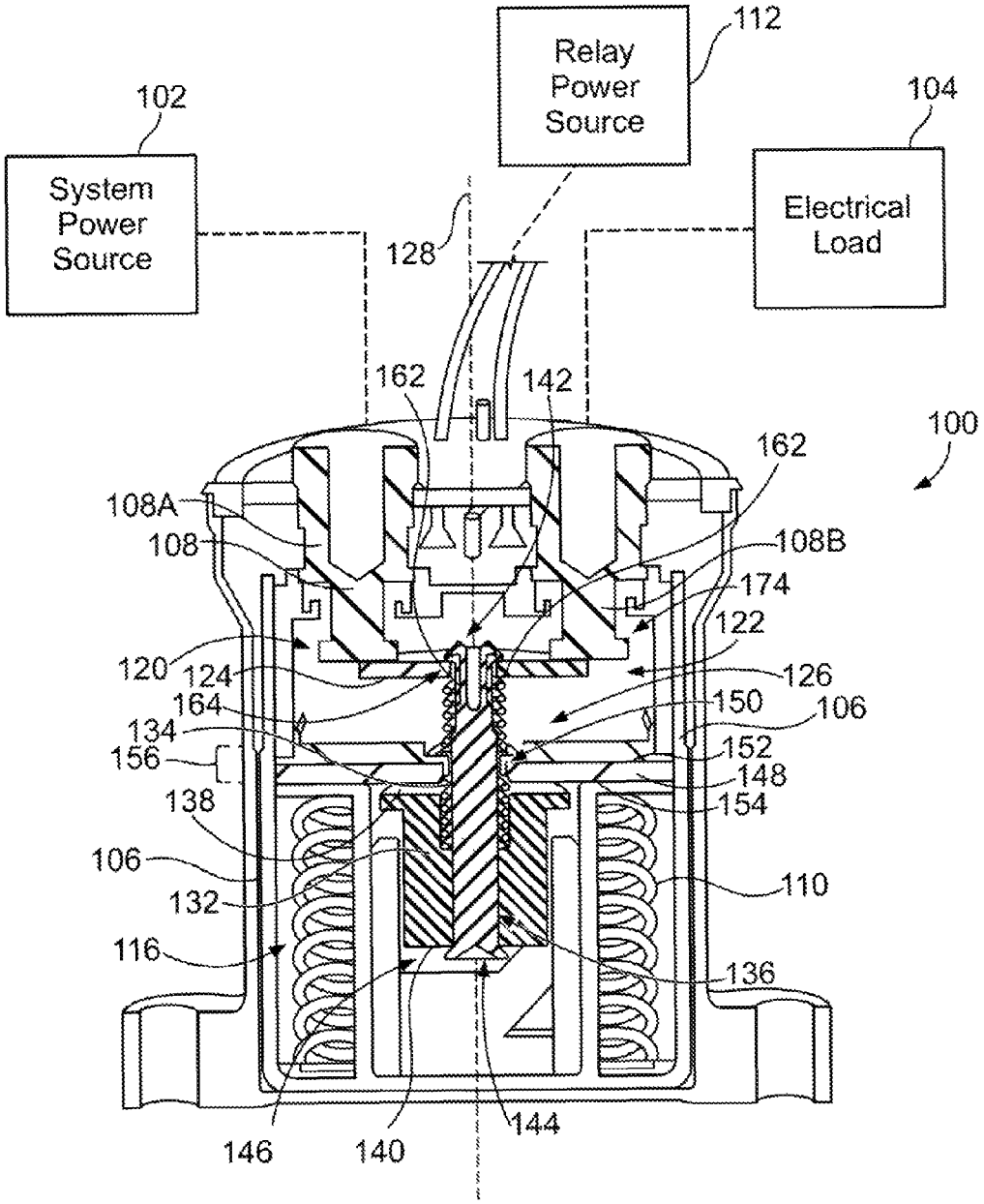
FIG. 2 is a front cross-sectional view of the electrical relay device of FIG. 1 with an actuator assembly in a second position.

FIG. 2 is a front cross-sectional view of the electrical relay device 100 with the actuator assembly 122 in the second position. When the actuator assembly 122 is in the second position, the movable contact 124 engages the stationary contacts 108 such that the movable contact 124 is conductively coupled to both stationary contacts 108. There is no gap between the movable contact 124 and the stationary contacts 108. The second position of the actuator assembly 122 may be referred to herein as a closed circuit position. The movable contact 124, when in the closed circuit position, provides a closed circuit path between the two stationary contacts 108. For example, electrical current is allowed to flow from one stationary contact 108 to the other stationary contact 108 across the movable contact 124, which bridges the distance between the stationary contacts 108. In the illustrated embodiment, when the actuator assembly 122 is in the closed circuit position, electrical current from the system power source 102 is conveyed to a first stationary contact 108A of the stationary contacts 108, across the movable contact 124, through a second stationary contact 108B of the stationary contacts 108, and to the electrical load 104 to power the load 104. In response to the actuator assembly 122 moving away from the closed circuit position towards the open circuit position, the movable contact 124 disengages the stationary contacts 108, which breaks the circuit and ceases the flow of electrical current between the system power source 102 and the electrical load 104. Although two stationary contacts 108 are shown in FIGS. 1 and 2, it is recognized that the electrical relay device 100 in other embodiments may have a different number of stationary contacts 108 and/or a different arrangement of stationary contacts 108. For example, the movable contact 124 may be permanently electrically connected a first stationary contact and may be configured to move relative to a second stationary contact, engaging and disengaging only the second stationary contact, in order to close and open a circuit between the two stationary contacts.

The position of the actuator assembly 122, and the movable contact 124 thereof, is controlled by the relay power source 112, which controls the supply of current to the wire coil 110 to induce the magnetic field. For example, the actuator assembly 122 may be in the open circuit position in response to the relay power source 112 not supplying electrical current to the wire coil 110 or in response to the relay power source 112 supplying an electrical current to the wire coil 110 that has insufficient voltage to induce a magnetic field capable of moving the actuator assembly 122 to the closed circuit position. The actuator assembly 122 may be moved to the closed circuit position in response to the relay power source 112 providing an electrical current to the wire coil 110 that has sufficient voltage to induce a magnetic field that moves the actuator assembly 122 to the closed circuit position. The relay power source 112 may provide between 2 volts (V) and 20 V of electrical energy to the wire coil 110 in order to move the actuator assembly 122 from the open circuit position to the closed circuit position. In an embodiment, the relay power source 112 provides 12 V of electrical energy to move the actuator assembly 122. By comparison, the system power source 102 may provide electrical energy through the electrical relay device 100 at higher voltages, such as at 120 V, 220 V, or the like. The flow of current from the relay power source 112 to the wire coil 110 is selectively controlled to operate the electrical relay device 100. For example, the relay power source 112 may be controlled by a human operator and/or may be controlled automatically by an automated controller (not shown) that includes one or more processors or other processing units.

The carrier sub-assembly 126 includes a plunger 132 and a shaft 134. The shaft 134 is fixed or secured to the plunger 132 such that the shaft 134 translates with the plunger 132 along the actuation axis 128. The plunger 132 extends between a top side 138 and a bottom side 140. The shaft 134 extends between a contact end 142 and an opposite plunger end 144. The shaft 134 is secured to the plunger 132 at or proximate to the plunger end 144. A segment of the shaft 134 including the contact end 142 protrudes from the top side 138 of the plunger 132. The shaft 134 is coupled to the movable contact 124 at or proximate to the contact end 142. The shaft 134, the plunger 132, and the movable contact 124 of the actuator assembly 122 are configured to move together along the actuation axis 128 towards and away from the stationary contacts 108.

In the illustrated embodiment, the plunger 132 defines a channel 136 that extends axially between the top side 138 and the bottom side 140. The shaft 134 is held within the channel 136 to secure the shaft 134 to the plunger 132. The shaft 134 may be held within the channel 136 by an interference fit, via one or more flanges on the shaft 134 that engage corresponding shoulders and/or surfaces of the plunger 132, via one or more deflectable latching features on the shaft 134 and/or the plunger 132, via an adhesive, and/or via discrete intervening fasteners, such as C-clips or E-clips. In an alternative embodiment, the carrier sub-assembly 126 may be formed as a unitary one-piece component in which the shaft 134 and the plunger 132 are formed integral to one another. For example, the plunger end 144 of the shaft 134 may be integral to the plunger 132.

In an embodiment, the movable contact 124 is disposed within the electrical circuit region 120 of the chamber 174, the plunger 132 is disposed within the electromagnetic region 116 of the chamber 174, and the shaft 134 extends into both the electrical circuit region 120 and the electromagnetic region 116. For example, the contact end 142 of the shaft 134 is within the electrical circuit region 120, and the plunger end 144 is within the electromagnetic region 116. The electrical relay device 100 further includes a core plate 148 within the chamber 174 that is fixed in place relative to the inner housing 106. The core plate 148 defines at least part of a divider wall 156 that separates the electrical circuit region 120 and the electromagnetic region 116. The core plate 148 defines an opening 150 that receives the shaft 134 therethrough. The shaft 134 extends through the opening 150 of the core plate 148 such that the contact end 142 is above a top side 152 of the core plate 148 and the plunger end 144 is below a bottom side 154 of the core plate 148. The core plate 148 is disposed between the movable contact 124 and the plunger 132. In an embodiment, the top side 138 of the plunger 132 is configured to engage the bottom side 154 of the core plate 148 when the actuator assembly 122 is in the closed circuit position, as shown in FIG. 2. For example, the bottom side 154 of the core plate 148 may provide a hard stop surface that limits the movement of the actuator assembly 122 towards the stationary contacts 108 to prevent excess movement that may damage the movable contact 124 or other components of the electrical relay device 100.

The plunger 132 may be surrounded by the coil 110 of wire. For example, the plunger 132 is disposed within a passage 146 that is radially interior of the wire coil 110. The plunger 132 is formed of a ferromagnetic material. For example, the plunger 132 may be formed of iron, nickel, cobalt, and/or an alloy containing one or more of iron, nickel, and cobalt. The plunger 132 has magnetic properties that allow the plunger 132 to translate in the presence of an induced magnetic field by the wire coil 110. In an embodiment, the shaft 134 is formed of a metal material that is different than the ferromagnetic material of the plunger 132. For example, the ferromagnetic material of the plunger 132 has a greater magnetic permeability than the metal material of the shaft 134. As used herein, magnetic permeability refers to a degree of magnetization that a material obtains in response to an applied magnetic field. The metal material of the shaft 134 optionally may be aluminum, titanium, zinc, or the like, or an alloy such as stainless steel or brass.

In an alternative embodiment, the plunger 132 and the shaft 134 are both at least partially formed of a common metal material. For example, the common metal material may be a ferromagnetic material, such as iron, nickel, cobalt, and/or an alloy thereof, such that the shaft 134 and the plunger 132 are both formed of the ferromagnetic material. The shaft 134 may be subsequently coated, such as via plating, painting, spraying, or the like, in a second metal material that has a reduced magnetic permeability relative to the ferromagnetic material used to form the shaft 134 and the plunger 132. The second metal material may reduce the magnetic permeability of the shaft 134 without affecting the magnetic permeability of the plunger 132. In another example, the common metal material used to form the plunger 132 and the shaft 134 is either not a ferromagnetic material or is a ferromagnetic material with a relatively low magnetic permeability (at least relative to pure iron), such as stainless steel. After the forming process, the plunger 132 may be coated, such as via plating, painting, spraying, or the like, in a second ferromagnetic material that has a greater magnetic permeability than the first ferromagnetic material used to form the shaft 134 and the plunger 132. The second ferromagnetic material may increase the magnetic permeability of the plunger 132 without affecting the magnetic permeability of the shaft 134.

As described above, the shaft 134 is coupled to the movable contact 124 at or proximate to the contact end 142 such that translation of the shaft 134 causes like movement of the movable contact 124 along the actuation axis 128. In the illustrated embodiment, the contact end 142 of the shaft 134 is defined by at least two deflectable prongs 162. The prongs 162 are configured to extend through an aperture 164 in the movable contact 124. The prongs 162 engage the movable contact 124 to secure the movable contact 124 on the shaft 134. In one or more alternative embodiment, the shaft 134 may be secured to the movable contact 124 by other means, such as by using a clip or another discrete intervening fastener. The movable contact 124 is formed of an electrically conductive first metal material, such as copper and/or silver. The movable contact 124 in an embodiment may be solid copper that is optionally silver-plated. The shaft 134 is formed of a different, second metal material, such as stainless steel (as described above). The first metal material of the movable contact 124 has a greater electrical conductivity than the second metal material of the shaft 134. Thus, the movable contact 124 conducts electricity more readily or to a greater degree than the shaft 134. Put another way, current flows with less resistance along the movable contact 124 than along the shaft 134. As a result, when the actuator assembly 122 is in the closed circuit position as shown in FIG. 2 and the movable contact 124 engages the stationary contacts 108, a substantial majority of the electrical energy propagates along the movable contact 124 between the stationary contacts 108 and an insubstantial amount of electrical energy, if at all, propagates along the shaft 134.

Referring now back to FIG. 1, the electrical relay device 100 in an embodiment is sealed. The electrical relay device 100 includes a shell 200. The shell 200 is coupled to the inner housing 106 at the open end 172. The shell 200 is configured to seal the opening 176 to the chamber 174 to isolate the chamber 174, and the components therein, from the exterior environment. For example, the shell 200 may provide a hermetic seal that is impervious to the transmission of gases, liquids, and solids into and out of the chamber 174. The sealed chamber 174 prevents dust, debris, humidity, and other contaminants from entering the chamber 174. Such contaminants may at least impede or obstruct the functionality of the electrical relay device 100 and potentially may damage components, such as the movable contact 124. The sealed chamber 174 also prevents fluid within the chamber 174 from unintentionally exiting the chamber 174. For example, the chamber 174 may be pressurized with nitrogen, oxygen, hydrogen, argon, or the like, in the gas phase. Optionally the chamber 174 is pressurized with a fluid containing only one element, such as pure nitrogen, or the fluid may include multiple elements, such as the case with air. The fluid may provide arc suppression, electrical insulation, and the like. In one embodiment, the fluid within the chamber 174 is nitrogen gas. The chamber 174 is hermetically sealed to prevent the fluid from escaping the chamber 174.

The shell 200 includes a top wall 202 that plugs the opening 176 to the chamber 174 at the open end 172 of the inner housing 106. The top wall 202 may extend generally perpendicular to a longitudinal axis of the inner housing 106 extending between the open end 172 and the closed end 170. The top wall 202 defines at least one port 206. Each port 206 is configured to receive a corresponding stationary contact 108 therethrough such that a portion of the stationary contact 108 is disposed within the chamber 174 and another portion of the stationary contact 108 is disposed external to the chamber 174. In the illustrated embodiment, the top wall 202 defines two ports 206 that each receive one of the two stationary contacts 108 therein. The portion of each stationary contact 108 within the chamber 174 is the portion that is configured to be engaged by the movable contact 124 when the actuator assembly 122 is in the closed circuit position, as shown in FIG. 2. The portion of each stationary contact 108 outside of the chamber 174 may be electrically terminated to an electrical conductor, such as a cable or a wire, used to connect the respective stationary contact 108 to an associated electrical component. Each port 206 is sealed to the corresponding stationary contact 108 that extends therethrough in order to seal the chamber 174. In an embodiment, the electrical conductors 194 that provide electrical energy from the relay power source 112 to the wire coil 110 for inducing a magnetic field are also routed through the top wall 202 of the shell 200. The electrical conductors 194 extend through respective orifices 220 (shown in FIG. 3) in the top wall 202 to enter the chamber 174 and access the wire coil 110. The orifices 220 are sealed around the electrical conductors 194 in order to seal the chamber 174.

In an embodiment, the top wall 202 has a pressure relief valve 204 that is in flow communication with the chamber 174. As used herein, the pressure relief valve 204 is in "flow communication" with the chamber 174 such that the pressure relief valve 204 is open to the chamber 174 and fluid within the chamber 174 is permitted to access and engage the pressure relief valve 204. The pressure relief valve 204 may be formed integral to the shell 200. For example, the shell 200 may be formed via a molding process, and the pressure relief valve 204, or at least a portion thereof, is formed in the top wall 202 during the molding process. In an alternative embodiment, the pressure relief valve 204 is a discrete component that is coupled or bonded to the top wall 202 and is sealed to the top wall 202. The pressure relief valve 204 is configured to open in response to a pressure within the chamber 174 exceeding a threshold set pressure in order to reduce the pressure within the chamber 174. For example, the pressure relief valve 204 includes a closed state and an open state. In the closed state, the pressure relief valve 204 is shut or sealed, such that none of the fluid (for example, no gasses or liquids) within the chamber 174 is allowed to escape the chamber 174 through the pressure relief valve 204, and no fluids or solids (such as debris) from outside the chamber 174 are allowed to enter the chamber 174 through the pressure relief valve 204. In the open state, the pressure relief valve 204 is open such that a leak path is formed that allows fluid within the chamber 174 to exit the chamber 174 and/or fluids and other contaminants outside the chamber 174 to enter the chamber 174, depending at least in part on the pressure differential between the chamber 174 and the ambient environment outside of the chamber 174. Upon opening, at least some of the fluid inside the chamber 174 is released through the pressure relief valve 204 to an exterior of the outer housing 178 of the electrical relay device 100. The pressure relief valve 204 may release the fluid to the exterior environment directly or indirectly via tubing 218 that extends from the pressure relief valve 204 outside of the outer housing 178.

The pressure relief valve 204 is configured to provide a mechanism for reducing the pressure of the chamber 174 to prevent structural damage to the electrical relay device 100 caused by a build-up of pressure. For example, pressure may build within the sealed chamber 174 due to a fault condition, in which electrical energy is supplied to at least one of the stationary contacts 108 at a rate or magnitude that exceeds the designed capabilities of the electrical relay device 100. The fault condition may be caused by a mechanical or electrical failure along the electrical circuit upstream of the electrical relay device 100. The electrical energy to the electrical relay device 100 as a result of the fault condition may increase the temperature and the pressure within the sealed chamber 174. As the pressure increases, the pressure risks exceeding structural limits of electrical relay device 100, which may force the electrical relay device 100 to bulge and deform, and even burst or explode. Such deformation and/or bursting would at least damage and likely destroy the electrical relay device 100, causing the relay device 100 to be immediately inoperable. Thus, if the electrical relay device 100 is being used to regulate the supply of electrical energy to the electrical load 104, the deformation and/or bursting of the electrical relay device 100 would likely immediately break the circuit, cutting off the current flow to the electrical load 104. The electrical load 104 would also likely be inoperable, at least temporarily, since the load 104 ceases to receive electrical energy used by the electrical load 104 to operate.

In an embodiment, the pressure relief valve 204 is configured to open when the pressure within the chamber 174 exceeds a threshold set pressure in order to reduce the pressure within the chamber 174 and prevent damage to the electrical relay device 100 from deforming and/or bursting due to the build-up of pressure. Thus, in a fault condition, the pressure within the chamber 174 may increase, but only until the pressure exceeds the threshold set pressure and the pressure relief valve 204 opens, releasing some of the fluid out of the chamber 174. The actuation of the pressure relief valve 204 reduces the pressure within the chamber 174, preventing damage to the electrical relay device 100. For example, the threshold set pressure, at which the pressure relief valve 204 is configured to open, is less than a fail pressure at which the electrical relay device 100 risks sustaining damage due to high pressure within the chamber 174. At pressures at or above the fail pressure, the electrical relay device 100 may bulge, deform, burst, and/or explode. The pressure relief valve 204 releases fluid from the chamber 174 before the pressure of the chamber 174 reaches the fail pressure. Thus, during a fault condition that supplies exceed electrical energy to the electrical relay device 100, the pressure relief valve 204 may open to reduce the build-up of pressure, but the electrical relay device 100 is unlikely to experience damage from the high pressure. After the fault condition, the electrical relay device 100 may continue to function and operate, such as to continue supplying current to the electrical load 104. Due to the pressure relief valve 204 breaking the seal to the chamber 174 (which may allow contaminants into the chamber 174) and allowing at least some fluid to escape from the chamber 174, it may be desirable to replace or at least perform maintenance on the electrical relay device 100 after the actuation of the pressure relief valve 204. But, it is recognized that the electrical relay device 100 having the pressure relief valve 204 would likely still be operable after a fault condition that builds the pressure in the chamber 174, whereas an electrical relay device known in the prior art would likely by inoperable after such a fault condition due to damage sustained from pressure build-up in a sealed vessel of the electrical relay device.

The shell 200 may be sealed to the inner housing 106 by covering at least a portion of the top wall 202 of the shell 200 with an epoxy material (not shown). For example, a seam 208 may be defined between the top wall 202 of the shell 200 and the inner housing 106. In the illustrated embodiment, the seam 208 extends between an outer edge 210 of the top wall 202 and an inner edge 212 of the inner housing 106 at the open end 172. The epoxy material covers the seam 208 to fill any leak paths through the seam 208, sealing the seam 208. The epoxy material may also cover the interfaces between the top wall 202 and the stationary contacts 108 at the ports 206, to seal the ports 206 to the stationary contacts 108. Furthermore, the epoxy material may cover interfaces between the top wall 202 and the electrical conductors 194 at the orifices 220 (shown in FIG. 3), to seal the orifices 220 to the electrical conductors 194. The epoxy material may be a moldable, thermosetting polymer that is impervious to the transmission of gases, liquids, and solids therethrough. In an embodiment, the epoxy material is applied over the top wall 202 of the shell 200 as a layer after the shell 200 is coupled to the inner housing 106.

The outer housing 178 includes a cover 214 at the open end 184 of the outer housing 178. In the illustrated embodiment, the stationary contacts 108, the electrical conductors 194, and the tubing 218 attached to the pressure relief valve 204 extend through the cover 214. The cover 214 is spaced apart from the top wall 202 of the shell 200 at the open end 172 of the inner housing 106, defining an axial gap 216 between the cover 214 and the top wall 202. In an embodiment, the epoxy material may be applied over the top wall 202 of the shell 200 as a layer that fills at least some of the gap 216. For example, the epoxy material may substantially fill the space within the gap 216. By "substantially fill" it is meant that at least a majority of the space between the outer housing 178 and the inner housing 106 is filled with the epoxy material. The epoxy material may follow the contours of the top wall 202, the inner surface 190 of the outer housing 178, the stationary contacts 108, the electrical conductors 194, and the pressure relief valve 204. Optionally, the epoxy material may also engage at least a portion of the cover 214.

Figure 3:
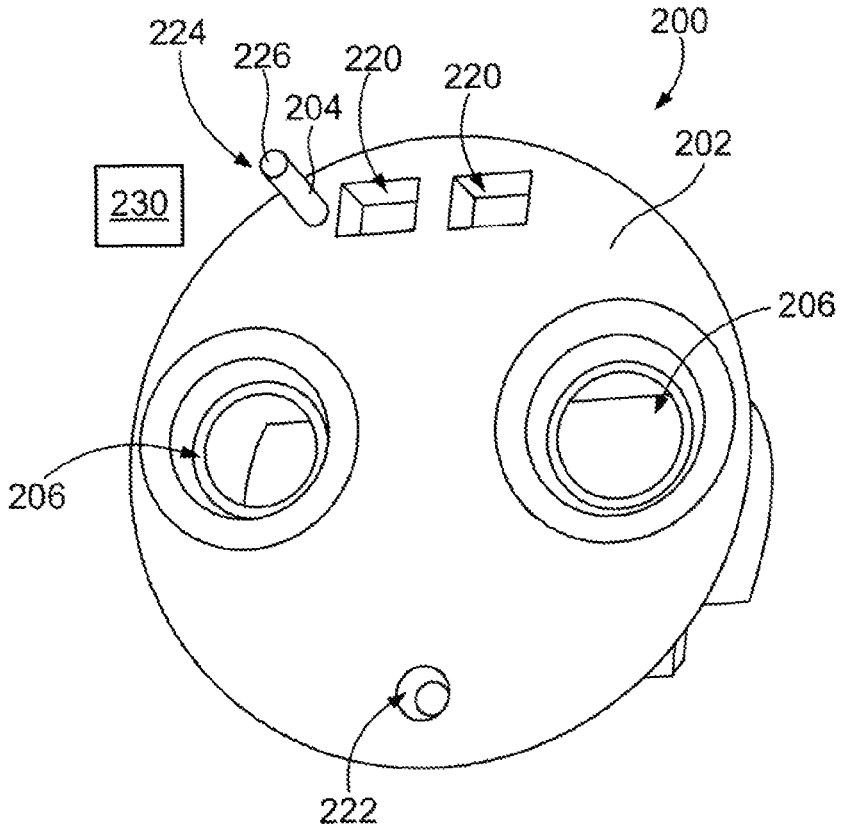
FIG. 3 is a top perspective view of a shell of the electrical relay device according to an embodiment.

FIG. 3 is a top perspective view of the shell 200 of the electrical relay device 100 (shown in FIG. 1) according to an embodiment. The shell 200 in FIG. 3 differs from the embodiment of the shell 200 shown in FIGS. 1 and 2 in the location of the pressure relief valve 204 on the top wall 202 of the shell 200. In FIG. 3, the pressure relief valve 204 is disposed to the side of the two orifices 220 that are configured to receive the electrical conductors 194 (shown in FIG. 1) therethrough. But, in FIGS. 1 and 2, the pressure relief valve 204 is located between the electrical conductors 194 that extend through the orifices 220. The pressure relief valve 204 may be located at different locations along the top wall 202 in different embodiments of the electrical relay device 100. For example, in another embodiment, the pressure relief valve 204 may be located closer to the ports 206 than the location of the pressure relief valve 204 in the illustrated embodiment. The top wall 202 also defines an aperture 222 that is configured to receive a supply tube (not shown) therethrough. The supply tube may be used to supply the fluid into the chamber 174 (shown in FIG. 1) prior to sealing the chamber 174. The aperture 222 is configured to be sealed, such as by using an epoxy material, after the fluid is supplied to the chamber 174 to seal the chamber 174. In the illustrated embodiment, the pressure relief valve 204 protrudes from the top wall 202, but the pressure relief valve 204 may extend through a side wall of the shell 200 in an alternative embodiment. For example, the pressure relief valve 204 may protrude through a side of the outer housing 178 above the edge of the inner housing 106.

In an embodiment, the pressure relief valve 204 is tube-shaped. The pressure relief valve 204 is hollow and is in flow communication with the chamber 174 (shown in FIG. 1), such that fluid from the chamber 174 is permitted at least partially into a conduit (not shown) defined by the hollow pressure relief valve 204. The pressure relief valve 204 may be formed integral to the shell 200 or, alternatively, may be a discrete component that is loaded into an opening of the top wall 202 and sealed to the top wall 202. In an embodiment, the pressure relief valve 204 includes a membrane 226 at or at least proximate to a distal end 224 of the pressure relief valve 204. The membrane 226 plugs the conduit. When the pressure relief valve 204 is in the closed state, the membrane 226 is intact and blocks the fluid within the chamber 174 from exiting the chamber 174 through the pressure relief valve 204. The membrane 226 may be configured to rupture in response to experiencing the threshold set pressure. The rupturing of the membrane 226 opens the pressure relief valve 204, providing a leak path across the membrane 226 that allows the fluid within the chamber 174 to flow beyond the membrane 226 and exit the chamber 174. The exiting fluid may be released from the pressure relief valve 204 directly into the ambient environment or may be conveyed through tubing 218 (shown in FIG. 1) that is coupled to the pressure relief valve 204. The membrane 226 may have a controlled thickness and/or attachment to the walls of the pressure relief valve 204 such that the membrane 226 ruptures at the threshold set pressure but does not rupture at pressures lower than the threshold set pressure. Once the membrane 226 ruptures to open the pressure relief valve 204, the pressure relief valve 204 may remain in the open state such that the pressure relief valve 204 does not return to the closed state, even when the pressure in the chamber 174 returns to a pressure lower than the threshold set pressure.

Optionally, the electrical relay device 100 (shown in FIG. 1) may additionally include a sensor 230 that is associated with the pressure relief valve 204. The sensor 230 is configured to detect when the pressure relief valve 204 is in the open state. For example, the sensor 230 may be disposed proximate to the membrane 226 to detect when the membrane ruptures. Alternatively, the sensor 230 may be disposed downstream of the membrane 226 in the flow path of the exiting fluid from the chamber 174. For example, the sensor 230 may be disposed at the distal end 224 of the pressure relief valve 204 or along the tubing 218 (shown in FIG. 1). The sensor 230 in such locations may be configured to detect fluid flow along the flow path that does not occur if the pressure relief valve 204 is in the closed state but does occur when the pressure relief valve 204 is in the open state. In response to detecting that the pressure relief valve 204 is open, the sensor 230 may be configured to transmit an electrical signal to a control system (not shown). The control system may process the signal and provide a diagnostic notification in response. The diagnostic notification may provide information, such as that the pressure relief valve 204 is open and/or that the electrical relay device 100 requires maintenance. The diagnostic notification may be communicated to an operator, such as by displaying the diagnostic notification as a symbol on a dashboard of a vehicle operated by the operator.

In an alternative embodiment, the pressure relief valve 204 is a spring-loaded valve that includes a compression coil spring (not shown) therein. The spring provides a biasing force on a valve that is overcome when the pressure within the chamber 174 (shown in FIG. 1) exceeds the threshold set pressure. At a pressure at or greater than the threshold set pressure, the spring compresses, allowing the fluid within the chamber 174 to exit the chamber 174 through the valve. As the fluid is released, the pressure of the fluid within the chamber 174 decreases. When the pressure lowers to a reseating pressure, the biasing force of the spring overcomes the force of the pressure exerted on the valve, and the pressure relief valve 204 closes. Thus, the pressure relief valve 204 in an alternative embodiment may be configured to both open and close based on the pressure in the chamber 174.

Figure 4:
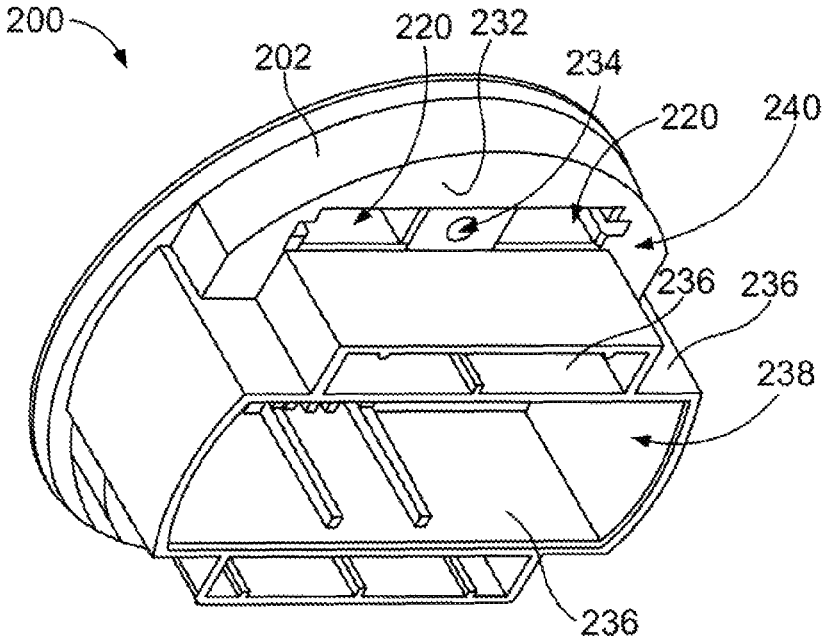
FIG. 4 is a bottom perspective view of the shell of the electrical relay device according to an embodiment.

FIG. 4 is a bottom perspective view of the shell 200 of the electrical relay device 100 (shown in FIG. 1) according to an embodiment. A bottom surface 232 of the top wall 202 defines an opening 234. The pressure relief valve 204

(shown in FIG. 3) aligns with the opening 234 such that the pressure relief valve 204 is in flow communication with the chamber 174 (shown in FIG. 1). In the embodiment of the shell 200 shown in FIG. 4, the pressure relief valve 204 is located between the two orifices 220 instead of to the side of the two orifices 220 as in the embodiment shown in FIG. 3. The shell 200 optionally includes internal walls 236 that extend from the bottom surface 232 of the top wall 202 into the chamber 174. The internal walls 236 sub-divide the chamber 174 into an interior region 238 and an exterior region 240. The exterior region 240 is radially exterior of the interior region 238. It is recognized that both the interior region 238 and the exterior region 240 are located within the chamber 174 defined by the inner housing 106 (shown in FIG. 1). The stationary contacts 108 (shown in FIG. 1) may extend through the respective ports 206 (FIG. 3) into the interior region 238, such that the movable contact 124 (FIG. 1) engages the stationary contacts 108 within the interior region 238. The orifices 220 and the opening 234 are not aligned with the interior region 238. As such, the electrical conductors 194 (shown in FIG. 1) extend through the respective orifices 220 into the exterior region 240. Similarly, the pressure relief valve 204 is in flow communication with the exterior region 240 through the opening 234.

The pressure relief valve 204 (shown in FIG. 3) may be in flow communication with the exterior region 240 in order to limit the exposure of the stationary contacts 108 (shown in FIG. 1) and the movable contact 124 (FIG. 1) to debris and other contaminants that may enter the chamber 174 (FIG. 1) after the pressure relief valve 204 opens. For example, once the pressure relief valve 204 opens due to a pressure in the chamber 174 exceeding the threshold set pressure, the chamber 174 is no longer hermetically sealed from the external environment, and it is possible that some contaminants may enter the chamber 174 through the pressure relief valve 204. The internal walls 236 may provide a barrier, although not necessarily a sealed barrier, to prohibit the contaminants from entering the interior region 238 and damaging the stationary and movable contacts 108, 124 or at least obstructing the functionality and operability of the electrical relay device 100 (shown in FIG. 1). Thus, the electrical relay device 100 is configured to be functional and operable even after a pressure build-up in the chamber 174 that causes the pressure relief valve 204 to open to reduce the pressure in the chamber 174.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical relay device comprising:

a housing extending between a closed end and an open end, the housing defining a chamber;

a coil of wire within the chamber of the housing, the coil of wire electrically connected to a relay power source;

an actuator assembly within the chamber of the housing that is configured to move between a first position and a second position based on a presence or absence of a magnetic field that is induced by current through the coil of wire, the actuator assembly including a movable contact that is spaced apart from at least one stationary contact within the chamber when the actuator assembly is in the first position and engages the at least one stationary contact to provide a closed circuit path when the actuator assembly is in the second position a shell coupled to the housing at the open end, the shell sealing the open end of the housing to seal the chamber, the shell having a pressure relief valve in flow communication with the chamber, the pressure relief valve being configured to open in response to a pressure within the chamber exceeding a threshold set pressure in order to break the seal provided by the shell and reduce the pressure within the chamber; and a sensor associated with the pressure relief valve, the sensor configured to detect when the pressure relief valve is open allowing fluid to exit the chamber through the pressure relief valve.

2. The electrical relay device of claim 1, wherein the electrical relay device further includes a divider wall that separates an electromagnetic region of the housing that includes the coil of wire therein and an electrical circuit region of the housing that includes the movable contact therein, the actuator assembly including a shaft that extends through an opening in the divider wall and is coupled to the movable contact such that translation of the shaft causes like movement of the movable contact, the pressure relief valve being in flow communication with the electrical circuit region.

3. The electrical relay device of claim 1, wherein a top wall of the shell defines at least one port, each port being configured to receive a corresponding stationary contact therethrough such that a portion of the stationary contact is within the chamber and another portion of the stationary contact is external to the chamber, each port being sealed to the corresponding stationary contact that extends therethrough to seal the chamber.

4. The electrical relay device of claim 1, wherein the chamber of the housing is hermetically sealed, the chamber being pressurized with at least one of nitrogen, hydrogen, oxygen, or argon.

5. The electrical relay device of claim 1, wherein the pressure relief valve is formed integral to the shell.

6. The electrical relay device of claim 1, wherein the housing is an inner housing that is held within an outer housing, wherein, upon opening, the pressure relief valve is configured to release fluid from inside the chamber to an exterior of the outer housing.

7. The electrical relay device of claim 1, wherein the shell includes internal walls that sub-divide the chamber into an interior region and an exterior region that is radially exterior of the interior region, the movable contact being disposed within the interior region, the pressure relief valve being in flow communication with the exterior region.

8. The electrical relay device of claim 1, wherein the pressure relief valve is tube-shaped, the pressure relief valve having a membrane that is configured to rupture in response to experiencing the threshold set pressure in order to open the pressure relief valve.

9. The electrical relay device of claim 1, wherein the housing is an inner housing that is held within an outer housing, the outer housing including a cover that is spaced apart from the open end of the inner housing such that an axial gap is defined between a top wall of the shell and the cover, the axial gap being substantially filled with an epoxy material.

10. An electrical relay device comprising:

a housing extending between a closed end and an open end, the housing defining a chamber;

a coil of wire within the chamber of the housing, the coil of wire electrically connected to a relay power source;

an actuator assembly within the chamber of the housing that is configured to move between a first position and a second position based on a presence or absence of a magnetic field that is induced by current through the coil of wire, the actuator assembly including a movable contact that is spaced apart from at least one stationary contact within the chamber when the actuator assembly is in the first position and engages the at least one stationary contact to provide a closed circuit path when the actuator assembly is in the second position; and a shell coupled to the housing at the open end, the shell sealing the open end of the housing to seal the chamber, the shell having a pressure relief valve in flow communication with the chamber, the pressure relief valve being configured to open in response to a pressure within the chamber exceeding a threshold set pressure in order to reduce the pressure within the chamber, wherein the shell includes internal walls that extend from a top wall of the shell and sub-divide the chamber into an interior region and an exterior region that is radially exterior of the interior region, the movable contact being disposed within the interior region, the pressure relief valve being disposed in the top wall in flow communication with the exterior region.

11. The electrical relay device of claim 10, wherein the threshold set pressure is less than a fail pressure at which the electrical relay device risks sustaining damage due to high pressure.

12. The electrical relay device of claim 10, wherein a top wall of the shell defines at least one port, each port being configured to receive a corresponding stationary contact therethrough such that a portion of the stationary contact is within the chamber and another portion of the stationary contact is external to the chamber, each port being sealed to the corresponding stationary contact that extends therethrough to seal the chamber.

13. The electrical relay device of claim 10, wherein the pressure relief valve is tube-shaped, the pressure relief valve having a membrane that is configured to rupture in response to experiencing the threshold set pressure in order to open the pressure relief valve.

14. The electrical relay device of claim 10, further comprising a sensor associated with the pressure relief valve, the sensor configured to detect when the pressure relief valve is open.

15. The electrical relay device of claim 10, wherein the housing is an inner housing that is held within an outer housing, wherein, upon opening, the pressure relief valve is configured to release fluid from inside the chamber to an exterior of the outer housing.

16. The electrical relay device of claim 10, wherein the chamber is sealed between a top wall of the shell and the open end of the housing via an epoxy material that at least partially covers a seam defined between an outer edge of the top wall and an inner edge of the housing at the open end.

17. The electrical relay device of claim 10, wherein the housing is an inner housing that is held within an outer housing, the outer housing including a cover that is spaced apart from the open end of the inner housing such that an axial gap is defined between a top wall of the shell and the cover, the axial gap being substantially filled with an epoxy material.

18. An electrical relay device comprising:

a housing extending between a closed end and an open end, the housing defining a chamber;

a coil of wire within the chamber of the housing, the coil of wire electrically connected to a relay power source;

an actuator assembly within the chamber of the housing that is configured to move between a first position and a second position based on a presence or absence of a magnetic field that is induced by current through the coil of wire, the actuator assembly including a movable contact that is spaced apart from at least one stationary contact within the chamber when the actuator assembly is in the first position and engages the at least one stationary contact to provide a closed circuit path when the actuator assembly is in the second position; and a shell coupled to the housing at the open end, the shell sealing the open end of the housing to seal the chamber, the shell having a pressure relief valve in flow communication with the chamber, the pressure relief valve being configured to open in response to a pressure within the chamber exceeding a threshold set pressure in order to reduce the pressure within the chamber, wherein the pressure relief valve has a membrane configured to rupture in response to experiencing the threshold set pressure, opening the pressure relief valve.

19. The electrical relay device of claim 18, further comprising a sensor associated with the pressure relief valve, the sensor configured to detect when the membrane of the pressure relief valve is ruptured such that the pressure relief valve is open.

20. The electrical relay device of claim 18, wherein the pressure relief valve is tube-shaped and formed integral to the shell.

* * * * *